US006780129B1

(12) United States Patent
Higuchi

(10) Patent No.: US 6,780,129 B1
(45) Date of Patent: Aug. 24, 2004

(54) BASKETBALL GAME SYSTEM

(75) Inventor: Ushio Higuchi, Tokyo (JP)

(73) Assignee: Yugen Kaisha Digital Nine, Tokyo (JP)

( * ) Notice: Subject to any disclaimer, the term of this patent is extended or adjusted under 35 U.S.C. 154(b) by 0 days.

(21) Appl. No.: 09/604,586

(22) Filed: Jun. 27, 2000

(51) Int. Cl.[7] ..... A63B 69/00; F41J 5/14; F41J 5/00

(52) U.S. Cl. ..... 473/447; 273/390; 273/378

(58) Field of Search ..... D21/701, 702, D21/703, 704, 705, 781; 273/317.3, 342, 398–402, 441, 127 R, 127 B; 473/446, 447, 448, 449, 478, 479, 480, 481, 482, 483, 484, 486, 487, 488, 489, 476, 485, 195, 196

(56) References Cited

U.S. PATENT DOCUMENTS 611,504 A * 9/1898 Perky ..... 273/400
1,211,379 A * 1/1917 Maisch ..... 273/368
1,372,712 A * 3/1921 McGrath et al. ..... 124/4
1,542,063 A * 6/1925 Knight ..... 124/7
1,616,270 A * 2/1927 Madden ..... 273/342
2,672,344 A * 3/1954 Wakefield ..... 273/141 R
3,050,304 A * 8/1962 Hulsebus ..... 273/1.5
3,134,594 A * 5/1964 Crowley ..... 273/350
3,244,420 A * 4/1966 Poynter ..... 231/1
3,365,196 A * 1/1968 Miller ..... 473/485
3,588,103 A * 6/1971 Fuller ..... 473/470
3,817,526 A * 6/1974 Bibb ..... 177/190
4,168,066 A * 9/1979 Sole et al. ..... 273/402
4,239,214 A * 12/1980 Brenner ..... 273/342
4,266,764 A * 5/1981 Collins ..... 272/3
4,268,029 A * 5/1981 Collins ..... 273/359
4,286,779 A * 9/1981 Collins ..... 273/402
4,747,597 A * 5/1988 Kluczny ..... 473/483
4,968,041 A * 11/1990 Calvo ..... 273/401
5,056,797 A * 10/1991 Hockert et al. ..... 273/402
5,096,191 A * 3/1992 Fang ..... 273/400
D349,933 S * 8/1994 Offutt ..... D21/702
5,364,091 A * 11/1994 Sebek ..... 473/433
5,692,979 A * 12/1997 Jones ..... 273/400
5,954,337 A * 9/1999 Cunningham ..... 273/338

OTHER PUBLICATIONS

Figure 1 of applicant's disclosed drawings.*

* cited by examiner

*Primary Examiner*—Stephen P. Garbe
*Assistant Examiner*—Alvin A. Hunter, Jr.
(74) *Attorney, Agent, or Firm*—Notaro & Michalos P.C.

(57) ABSTRACT

A frame supports as a base a plurality of goals rotatably. The goals are arranged asymmetrically with respect to the vertical axix from the view point of a player. Some goals hide others. When a ball shot by a player hits the frame of a goal. Then the goal rotates to guide the ball out of the goal. Unless a ball is directed to the central portion of the frame of the goal without hitting the frame, the possibility is low that the ball drops in the goal.

8 Claims, 4 Drawing Sheets

BASKETBALL GAME SYSTEM

TECHNICAL FIELD

This invention relates to a basketball game system using a target similar to a goal or loop used to play basketball game.

BACKGROUND ART

While playing basketball game, players shoot free throws from the free throw lane. Such free throw shoots are enjoyable even independent from a basketball game. The applicant developed a free throw game or competition, and proposed a basketball game system having nine hoops. Each goal consists of a goal ring and a ring net, and is mounted on the backboard. For example, as shown in FIG. 1, the system has three rows, each of which is composed of three goals 10. Nearer goals are lower than further goals. In this example, the loop at the central position is arranged at the normal loop position for basketball games. When a player gets goal-in with all the loops using twelve balls or less, the player wins the game. When the player miss five balls, the player looses the game. Moreover, the applicant proposed another game system which has a slightly different loop position arrangement, and moves some loops right and left and other loops up and down. The success rate decreases further with this game system, and a player can enjoy the game much more. The present invention accordingly aims at providing a basketball system which asks a game player more excellent skills.

DISCLOSURE OF THE INVENTION

According to one aspect of the present invention, in order to attain the above mentioned object, a basketball game system comprises a base member, and a plurality of goals mounted on the base member, at least one of the goals being supported rotatably on the base member.

In this configuration, when a ball hits the frame of a goal, the goal rotates, and the possibility that the ball enters the goal is lowered. Therefore, a player is required a high game level, and can enjoy playing the game much more.

The above mentioned aspect and other aspects of the present invention are defined in the appended claims, and are fully described in the following description.

BEST MODE FOR CARRYING OUT OF THE INVENTION

The embodiment of the present invention will be described below.

Figure 1:
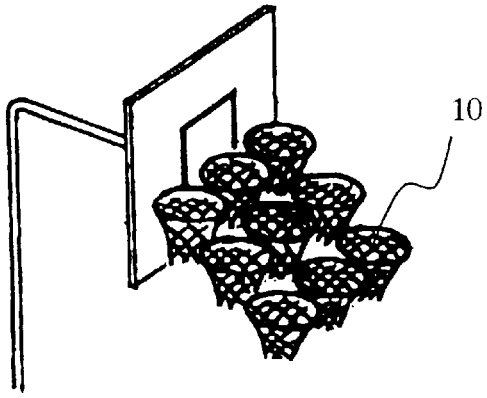
FIG.1 PRIOR ART
FIG. 1 illustrates a prior art system.
Figure 2:
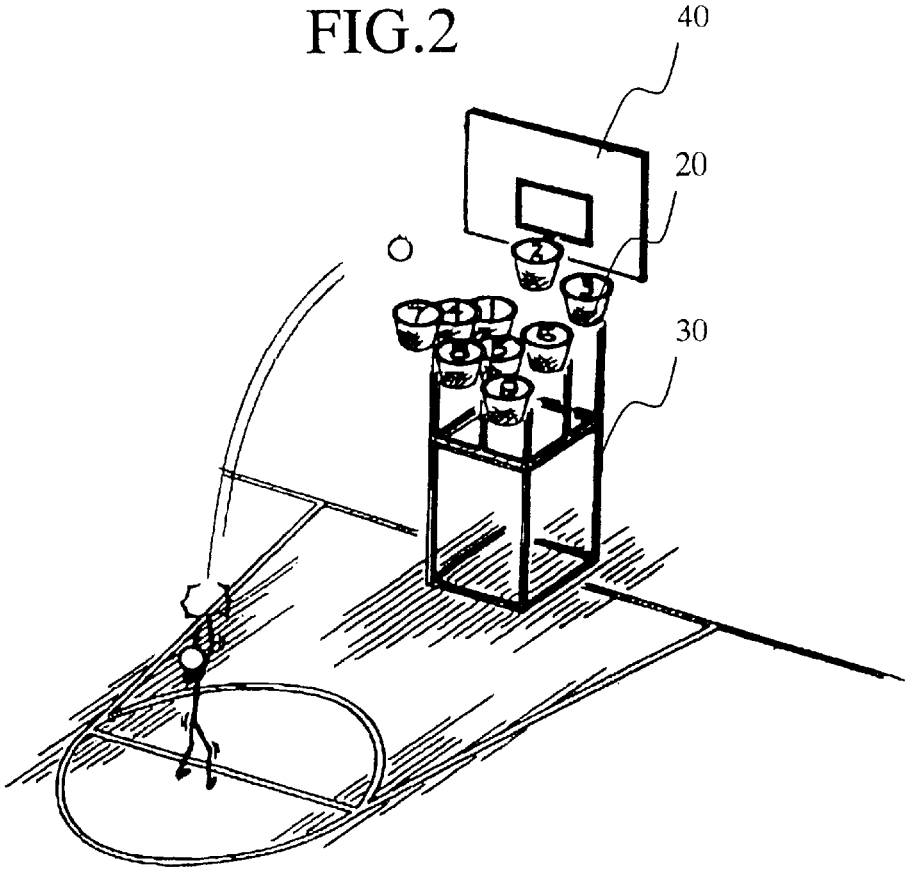
FIG. 2 illustrates how to play the embodiment of the present invention.

FIG. 2 illustrates how to play the embodiment of the invention, and in this figure, a player shoots free throws to the nine goals 20 from the free throw lane. For example, when the player shoot balls in all the goals 20 with twelve balls or less, the player wins the game. Of course, victory or defeat can be decided according to the number of balls which are shot in the goals 20. The respective goals 20 are indicated with the reference numbers of 1–9 for convenience sake. Of course, such indications can be actually fixed.

Figure 3:
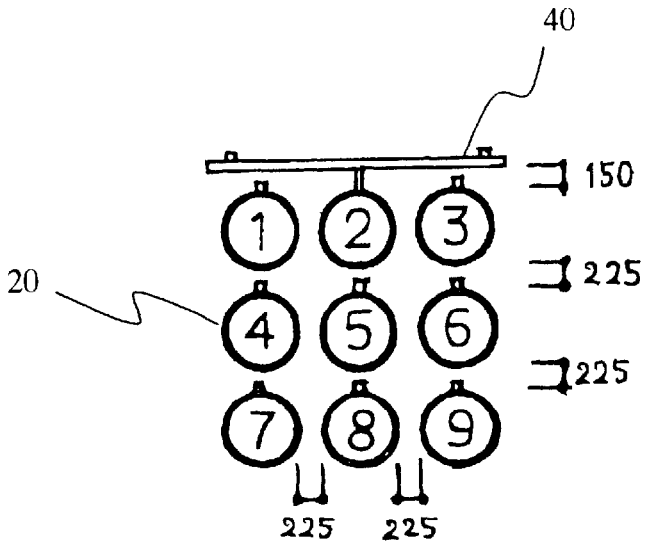
FIG. 3 shows the plan view of the arrangement of the loops used in the embodiment.
Figure 4:
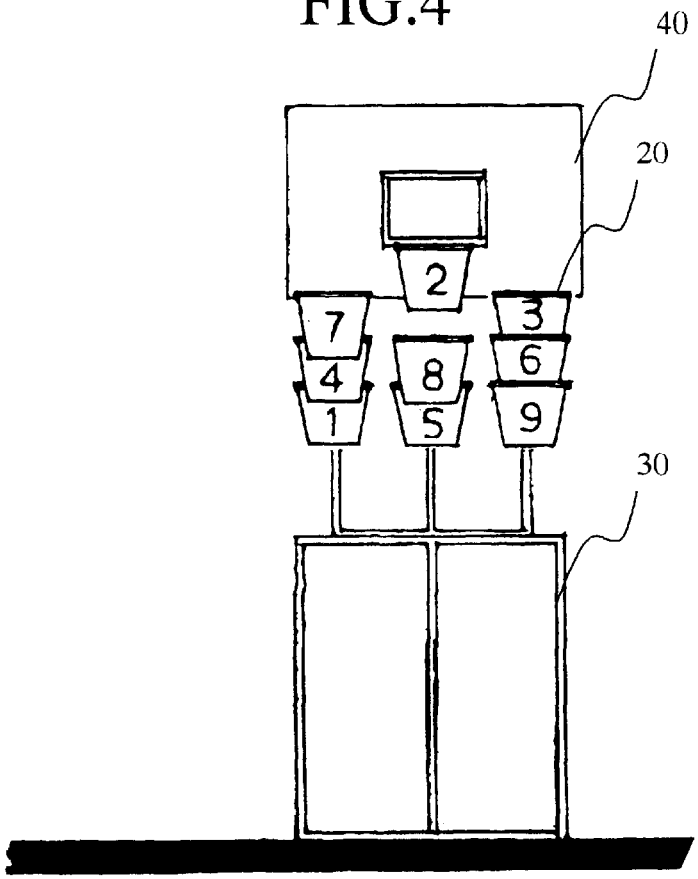
FIG. 4 shows the front view of the arrangement of the loops used in the embodiment.
Figure 5:
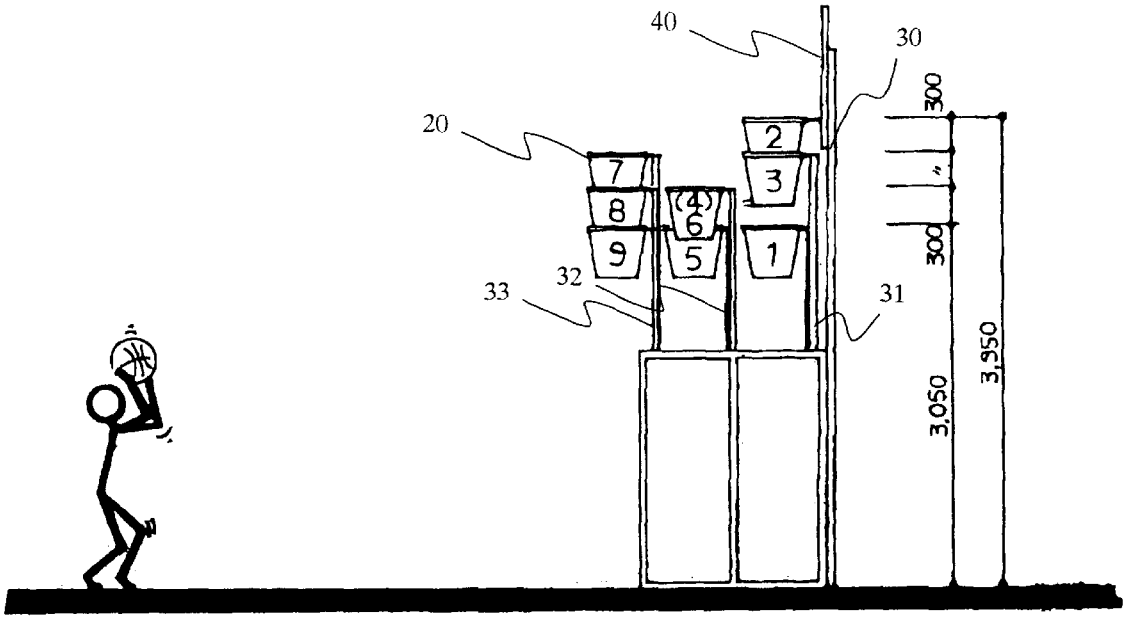
FIG. 5 shows the side view of the arrangement of the loops used in the embodiment.

FIG. 3 shows the plan view of the arrangement of the goals 20, and FIG. 4 shows the front view of the same, and FIG. 4 shows the right side view of the same. With reference to FIG. 3 through FIG. 5, the nine goals are mounted on the base frame 30 and the backboard 40. The backboard 40 is fixedly mounted on the base frame 30. As to the goals (No. 9, 6, 3) in the right column when viewing from the front, further goal is higher than nearer one. And, the goals 20 of No. 6 and No. 3 are arranged to be hidden from the player by the goal 20 of No. 9. As to the goals in the central column, the middle goal 20 of No. 5 has the lowest position, and the nearest goal 20 of No. 8 has the intermediate position, and the furthest goal 20 of No. 2 has the highest position. In addition, as to the goals 20 in the left column, nearer goal is higher than further one. Because the arrangement of goals 20 is thus designed asymmetrically with respect to the vertical axis and in a random manner, it is difficult to shoot a ball in a goal 20.

In the example as shown in the figures, the No. 2 goal is mounted on the backboard 40, and the No. 1 and No. 3 goals 20 are mounted the rear frame segment 31. The No. 4, No. 5, and No. 6 goals 20 are mounted on the central frame segment 32, and the No. 7, No. 8, and No. 9 goals 20 are mounted on the front frame segment 33.

Figure 6:
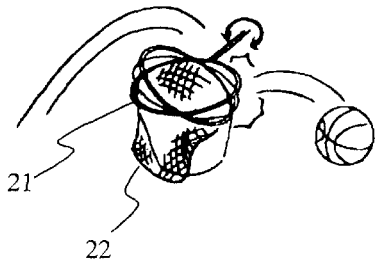
FIG. 6 illustrates the characteristic operation of the loops used in the embodiment.
Figure 7:
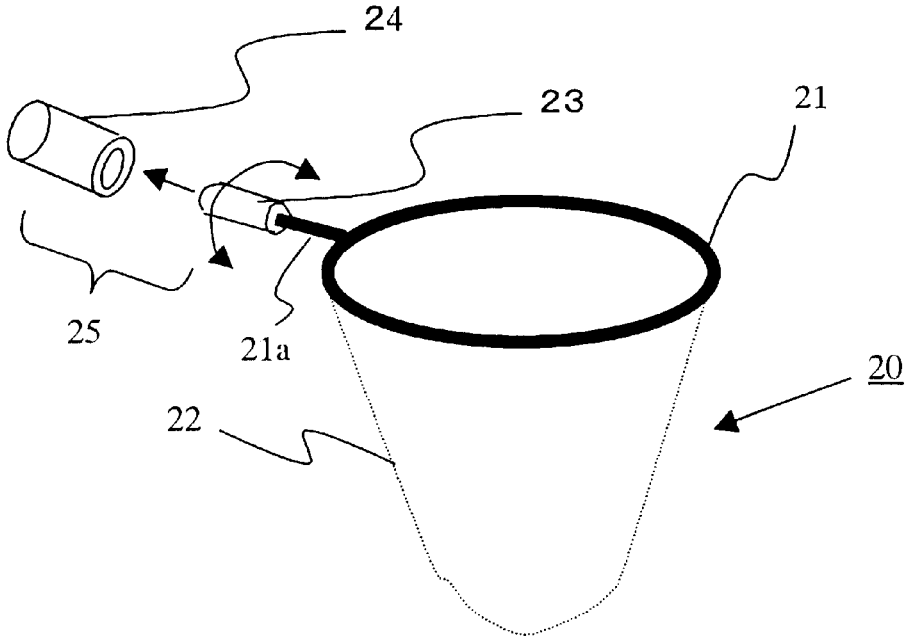
FIG. 7 illustrates the attachment of the loop used in the embodiment.
Figure 8:
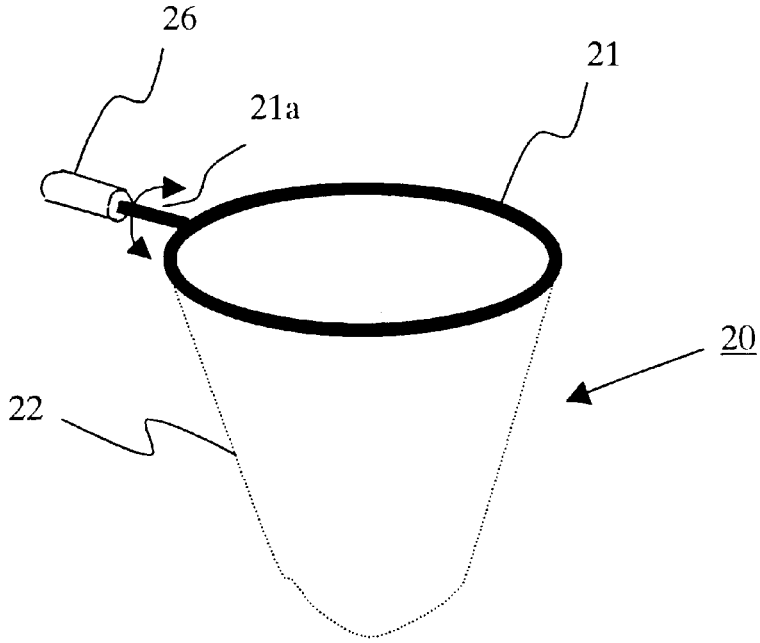
FIG. 8 illustrates another attachment of the loop used in the embodiment.

The goals 20 are the same as a usual goal used for a basketball game, and each consists of a goal ring 21 the inside diameter of which is 400 mm and a ring net 22 attached to the goal ring 21 (refer to FIG. 6 through FIG. 8). However, the bottom of the ring net 22 is closed such that the net 22 holds a ball which is shot in the ring. Therefore, it is easy to determine whether or not a ball is shot in a goal 20. The No. 5 goal 20 is arranged at the usual goal position.

The height positions of the rings of the respective goals 20 are shown in the table below.

| height of ring of goal 20 (mm) | No. of goal 20 |
|---|---|
| 3950 | 2 |
| 3650 | 3, 7 |
| 3350 | 4, 6, 8 |
| 3050 | 1, 5, 9 |

Moreover, the rings of adjacent goals 20 are as shown in FIG. 2 arranged at a interval of 225 mm, and the rings of the goals 20 in the rear row are apart from the backboard 30 by 150 mm.

In addition, as shown in FIG. 6, the goals 20 of the embodiment are supported rotatably. For example, as shown in FIG. 7, a ball bearing 25 is used which composed of an inner member 23, an outer member 24 and balls (not shown). The inner member supports the extension member 21*a* of the goal ring 21 of a goal 20. The outer member is fixedly mounted on the support frame 30 or the backboard 40. Alternatively, as shown in FIG. 8, the extension member 21*a* of the goal ring 21 is attached to the frame 30 or backboard 40 through a cylindrical member 26. The extension member

21*a* of the goal ring 21 is rotatably supported by the cylindrical member 26 with lubricant material.

The loops are supported rotatably as mentioned above, the possibility is lowered that a ball hitting the frame of a goal 20 drops in the goal.

As described above, in the embodiment, the right and left arrangement of the goals is asymmetry, and some goals hides others, and further, the goals are supported rotatably. Therefore, it is difficult to shoot free throws in the goals, and then the player enjoys the game.

The present invention is not limited to the embodiment described above and variants and modifications can be made. For example, only some of the goals may be supported rotatably, other being supported fixedly. Moreover, the size of the goal can be bigger or smaller though it has preferably has the same size as the usual goal.

What is claimed is:

1. A basketball game system comprising:

a single backboard and a plurality of goals mounted at horizontally different locations in front of the backboard, at least one of the plurality of goals having a ring and rotation means for permitting non-motorized rotation of the ring respective to the backboard and around an horizontal axis extending frontwards perpendicular to said backboard such that said at least one of the plurality of goals rotates around the horizontal axis upon a ball hitting the ring of said at least one of the plurality of goals at a portion of the ring except at the horizontal axis, so that the ball hitting the ring at said portion of the ring falls out of said at least one of the plurality of goals with a high probability.

2. The basketball game system according to claim 1, wherein the plurality of goals are asymmetrically aligned along the backboard.

3. The basketball game system according to claim 1, wherein there are nine goals in the system.

4. The basketball game system according to claim 1, wherein a bottom of a ring net of each of the goals is closed.

5. A basketball game system comprising:

a single backboard and a plurality of goals mounted at horizontally different locations In front of the backboard, at least one of the plurality of goals having a ring rotatably mounted respective to the backboard via a bail bearing connection for rotation and around an horizontal axis extending frontwards perpendicular to said backboard such that said at least one of the plurality of goals only rotates around the horizontal axis upon a ball or object hitting the ring of said at least one of the plurality of goals at a portion of the ring except at the horizontal axis, so that the ball hitting the ring at said portion of the ring falls out of said at least one of the plurality of goals with a high probability.

6. The basketball game system according to claim 5, wherein the plurality of goals are asymmetrically aligned along the backboard.

7. The basketball game system according to claim 5, wherein there are nine goals in the system.

8. The basketball game system according to claim 5, wherein a bottom of a ring net of each of the goals is closed.

* * * * *